US007357172B2

(12) United States Patent
Teng et al.

(10) Patent No.: US 7,357,172 B2
(45) Date of Patent: Apr. 15, 2008

(54) CHECK VALVE WITH A SPIRAL COIL SEAL

(75) Inventors: Alex Teng, Richmond Hill (CA); Harold Godwin, Orangeville (CA); Robert Ilmonen, Mississauga (CA)

(73) Assignee: Husky Injection Molding Systems Ltd., Bolton, Ontario (CA)

( * ) Notice: Subject to any disclaimer, the term of this patent is extended or adjusted under 35 U.S.C. 154(b) by 292 days.

(21) Appl. No.: 10/876,584

(22) Filed: Jun. 28, 2004

(65) Prior Publication Data

US 2005/0284601 A1 Dec. 29, 2005

(51) Int. Cl.
*B22D 17/08* (2006.01)

(52) U.S. Cl. ..... 164/312

(58) Field of Classification Search ..... 164/113, 164/312

See application file for complete search history.

(56) References Cited

U.S. PATENT DOCUMENTS 1,667,092 A * 4/1928 Ahern et al. ..... 277/445
3,578,803 A 5/1971 Huhn
3,655,206 A 4/1972 Adams
4,135,873 A * 1/1979 Sone et al. ..... 425/147
4,311,185 A * 1/1982 Zimmerman ..... 164/315
4,576,381 A * 3/1986 Slack ..... 277/458
4,966,539 A * 10/1990 Pena ..... 425/208
5,040,589 A * 8/1991 Bradley et al. ..... 164/113
5,092,361 A * 3/1992 Masuyama et al. .... 137/543.21
6,113,380 A * 9/2000 Hara ..... 425/559
2002/0100507 A1 8/2002 Hauser et al.
2004/0001900 A1 1/2004 Dominka

* cited by examiner

*Primary Examiner*—Kevin P. Kerns

(57) ABSTRACT

A seal for a check valve for a metal molding machine. The seal is provided by the combination of a peripheral groove in an outer surface of the check valve and a helically wound core in the groove. The helically wound coil is expandable into sealing engagement with a cylindrical wall of the molding machine. The helically wound coil may be movable laterally in the groove between a melt channel open position and a melt channel closed position to open or seal the melt channel.

9 Claims, 8 Drawing Sheets

CHECK VALVE WITH A SPIRAL COIL SEAL

BACKGROUND OF INVENTION

1. Field of the Invention

The present invention relates, generally, to check rings and seals for injection molding machines and more particularly, but not exclusively, the invention relates to check rings and seals for metal injection molding machines and die casting machines.

2. Background Information

The state of the art includes U.S. Pat. No. 3,578,803 issued May 18, 1971 to Huhn that describes the use of a spiral spring to urge a seal ring towards a counter-ring to create a seal on a shaft.

U.S. Pat. No. 3,655,206 issued Apr. 11, 1972 to Duramettallic Corp. describes the use of a spiral sealing ring that is pressed against a wedge shaped surface to apply a radially inward and axial compressive force to the sealing ring to form a seal around a shaft. The sealing ring is constructed of multiple layer graphite material. The sealing ring is designed to maintain a seal around the shaft.

U.S. Patent Application 2002/0100507 published Aug. 1, 2002 by Hauser et al describes a check valve for a piston pump in an automotive braking system. The check valve is formed as a single piece consisting of a helical coil with a base ring on one end and a closure disk on the other end. Movement of the base ring provides the opening and closing of the check valve. The helical spring provides the opening and closing mobility of the valve. The outer surfaces of the helical spring are not used as closing or sealing surfaces.

U.S. Patent Application 2004/0001900 published Jan. 1, 2004 by Dominka describes a check valve for an injection system. The valve includes a shut-off pin, a spring guide member and a helical spring. The helical spring is compressed by the guide member to force the pin to close the flow path and decompressed to enable the flow path to open. The surfaces of the helical spring are in contact with the flow path but do not provide any of the closing or sealing surfaces.

None of the prior art suggests the use of a spiral coil to actually seal a flow channel.

There is a need for a wear resistant reliable seal for sealing the flow path through check valves in injection molding machines.

SUMMARY OF INVENTION

In the injection molding of plastics it is common to employ check valves without any seals and to rely on the comparatively large clearance and the high viscosity of the melt to create full sealing. Metals used in metal injection molding do not have the high viscosity of plastics and therefore will leak back through the clearances that are typically employed in plastic injection molding. In addition, the highly corrosive nature of the metals and the high temperatures required for injection also debilitate against using plastic injection molding sealing arrangements in metal injection molding. Accordingly, an effective seal for metal injection molding is required to have a tight clearance and tolerance and must withstand high temperatures and corrosive environments. The present invention provides such a seal using a spiral coil.

The present invention provides a seal for injection molding machine that prevents back flow of melt in a check valve, reduces wear in the barrel and check valve and will operate reliably even when significant wear is present. The invention is achieved by providing a spiral coil to seal the channel. The spiral coil may also act as a check ring to open and close the melt path.

The present invention provides a seal for a check valve for a metal molding machine. The seal comprises a peripheral groove in an outer surface of the check valve and a helically wound coil in the groove. The helically wound coil is expandable into sealing engagement with a cylindrical wall of the molding machine.

The present invention further provides a check valve for a metal molding machine. The valve includes a helically wound coil. The coil seals the check valve and slides on a cylinder of the check valve to open and close a flow path through the valve. A first turn of the coil has a surface conforming to a mating surface on the cylinder to close the valve when in contact with the mating surface. Outer peripheral surfaces of the coil conform to a cylinder wall surrounding the check valve to provide an axial seal for the check valve.

The present invention further provides an injection unit for an injection molding machine including an injection screw, a nozzle body on one end of the injection screw and a check valve on the nozzle body. The check valve includes a sealing ring. The sealing ring comprises a helically wound coil that surrounds the nozzle body and is slidable between a first position where the nozzle is open and a second position where the nozzle is closed. A first turn of the coil sealingly engages a shoulder on the nozzle body when the coil is in the closed position.

BRIEF DESCRIPTION OF DRAWINGS

Exemplary embodiments of the present invention will now be described with reference to the accompanying drawings, in which.

DETAILED DESCRIPTION

The structure and operation of the present invention will be explained, hereinafter, within the context of improving the function and durability of a check valve that is configured for use in a barrel assembly of an injection molding system for the molding of a metal alloy, such as those of Magnesium, in a semi-solid (i.e. thixotropic) state. A detailed description of the construction and operation of several of such injection molding systems is available with reference to U.S. Pat. Nos. 5,040,589 and 6,494,703. Notwithstanding the foregoing, no such limitation on the general utility of the check valve of the present invention is intended, or its compatibility with other metal alloys (e.g. Aluminum, Zinc, etc.).

Figure 1:
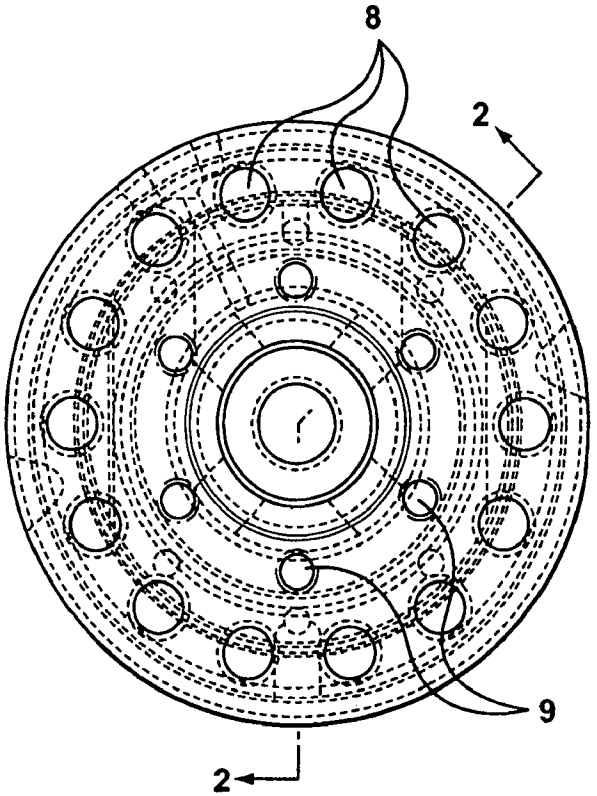
FIG. 1 is an end view of barrel assembly for a metal injection molding machine.
Figure 1A:
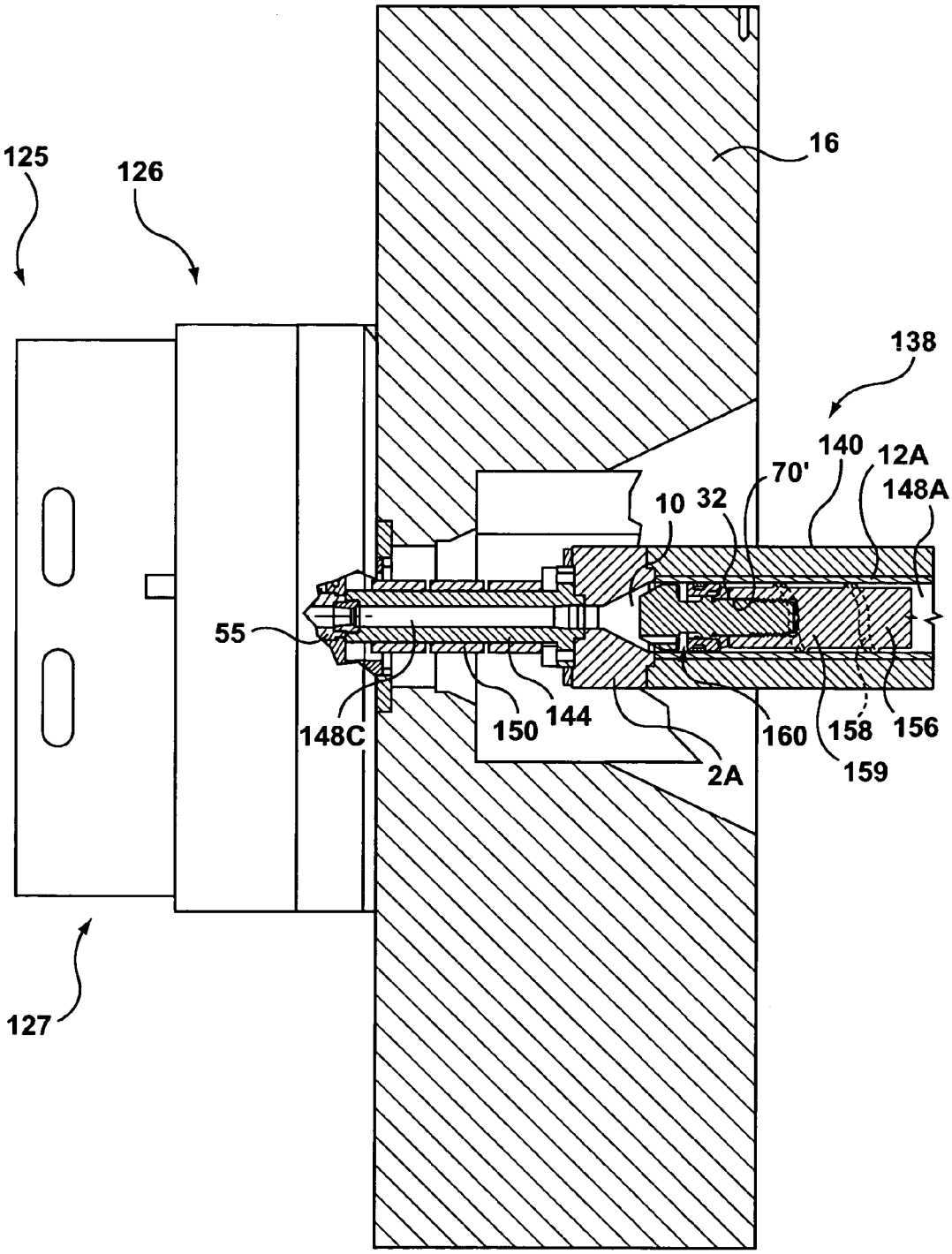
FIG. 1A (PRIOR ART)
FIG. 1A illustrates a barrel assembly of a typical injection molding system on which the present invention is useful.

The barrel assembly of a typical injection molding system is shown with reference to FIG. 1A.

The barrel assembly 138 is shown to include an elongate cylindrical barrel 140 with an axial cylindrical bore 148A arranged therethrough. The barrel assembly is shown connected to a stationary platen 16 of a clamping unit (not otherwise shown). The bore 148A is configured to cooperate with the screw 156 arranged therein, for processing and transporting metal feedstock, and as a means for accumulating and subsequently channeling a melt of molding material during injection thereof. The screw 156 includes a helical flight 158 arranged about an elongate cylindrical body portion 159. A rear portion of the screw, not shown, is configured for coupling with a drive assembly, not shown, and a forward portion of the screw 156 is configured for receiving a check valve 160, in accordance with an embodiment of the present invention. An operative portion of the check valve 160 is arranged in front of a forward mating face or shoulder 32 of the screw 156. The barrel assembly 138 includes a barrel head 2A that is positioned intermediate the machine nozzle 144 and a front end of the barrel 140. The barrel head 2A includes a melt passageway 10 arranged therethrough that connects the barrel bore 148A with a complementary melt passageway 148C arranged through the machine nozzle 144. The melt passageway 10 through the barrel head 2A includes an inwardly tapering portion to transition the diameter of the melt passageway to the much narrower melt passageway 148C of the machine nozzle 144. The central bore 148A of the barrel 140 includes a lining 12A made from a corrosion resistant material, such as Stellite™, to protect the barrel substrate material, commonly made from a nickel-based alloy such as Inconel™, from the corrosive properties of the high temperature metal melt. Other portions of the barrel assembly 138 that come into contact with the melt of molding material may also include similar protective linings or coatings. The barrel 140 is further configured for connection with a source of comminuted metal feedstock through a feed throat, not shown, that is located through a top-rear portion of the barrel 140, not shown. The feed throat directs the feedstock into the bore 148A of the barrel 140. The feedstock is then subsequently processed into molding material by the mechanical working thereof, by the action of the screw 156 in cooperation with the barrel bore 148A, and by controlled heating thereof. The heat is provided by a series of heaters, not shown, that are arranged along a substantial portion of the length of the barrel assembly 138 and heaters 150 along machine nozzle 144.

The injection mold includes at least one molding cavity, not shown, formed in closed cooperation between complementary molding inserts shared between a mold cold half, not shown, and a mold hot half 125. The mold cold half includes a core plate assembly with at least one core molding insert arranged therein. The mold hot half 125 includes a cavity plate assembly 127, with the at least one complementary cavity molding insert arranged therein, mounted to a face of a runner system 126. The runner system 126 provides a means for connecting the melt passageway 148C of the machine nozzle 144 with the at least one molding cavity for the filling thereof. As is commonly known, the runner system 126 may be an offset or multi-drop hot runner, a cold runner, a cold sprue, or any other commonly known melt distribution means. In operation, the core and cavity molding inserts cooperate, in a mold closed and clamped position, to form at least one mold cavity for receiving and shaping the melt of molding material received from the runner system 126.

In operation, the machine nozzle 144 of the barrel assembly 138 is engaged in a sprue bushing 55 of the injection mold whilst the melt is being injected into the mold.

The molding process generally includes the steps of:

i) establishing an inflow of metal feedstock into the rear end portion of the barrel 140;

ii) working (i.e. shearing) and heating the metal feedstock into a thixotropic melt of molding material by:

a) the operation (i.e. rotation and retraction) of the screw 156 that functions to transport the feedstock/melt, through the cooperation of the screw flights 158 with the axial bore 148A, along the length of the barrel 140, past the check valve 160, and into an accumulation region defined in front of the check valve 160;

b) heating the feedstock material as it travels along a substantial portion of the barrel assembly 138;

iii) closing and clamping of the injection mold halves;

iv) injecting the accumulated melt through the machine nozzle 144 and into the injection mold by a forward translation of the screw 156;

v) optionally filling any remaining voids in the at least molding cavity by the application of sustained injection pressure (i.e. packing);

vi) opening of the injection mold, once the molded part has solidified through the cooling of the injection mold;

vii) removal of the molded part from the injection mold; and viii) optionally conditioning of the injection mold for a subsequent molding cycle (e.g. application of mold release agent).

The steps of preparing a volume of melt for subsequent injection (i.e. steps i) and ii)) are commonly known as 'recovery', whereas the steps of filling and packing of the at least one mold cavity (i.e. steps iv) and v)) are commonly known as 'injection'.

The check valve 160 functions to allow the forward transport of melt into the accumulation region at the front of the barrel 140 but otherwise prevents the backflow thereof during the injection of the melt. The proper functioning of the check valve 160 relies on a pressure difference between the melt on either side thereof (i.e. higher behind the valve during recovery, and higher in front during injection). The structure and operation of a typical check valve, for use in metal injection molding, is described in U.S. Pat. No. 5,680,894.

Figure 2:
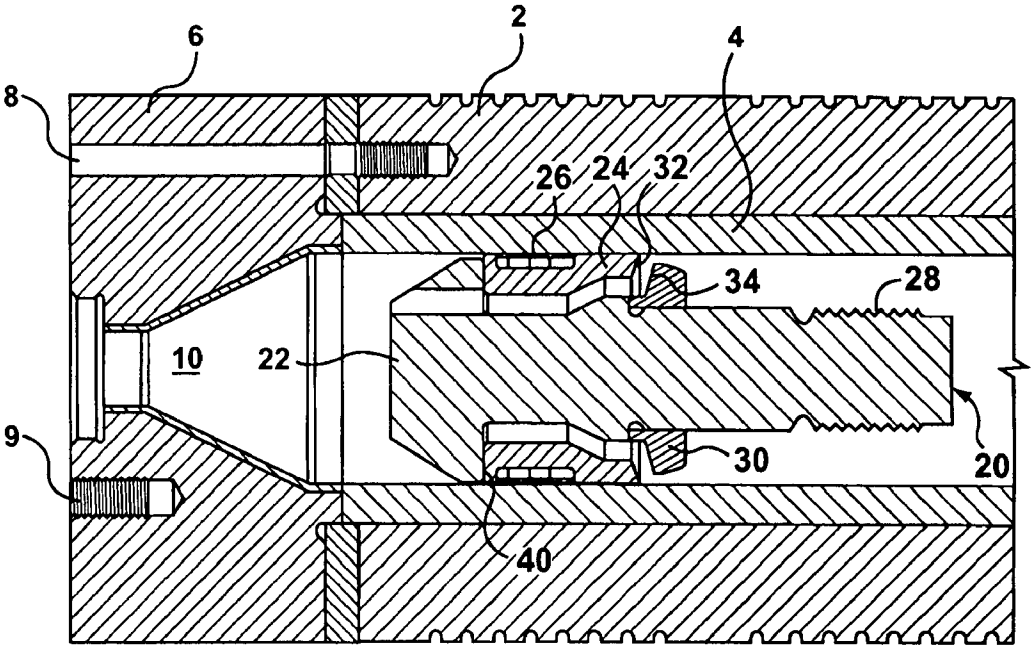
FIG. 2 is a cross sectional view of the barrel assembly of FIG. 1 taken along the sectional line 2-2 of FIG. 1 showing the spiral seal provided by the present invention.

Referring to FIGS. 1 and 2, a spiral coil used in accordance with a preferred embodiment of the present invention is generally shown. FIG. 1 shows the use of the coil as a seal.

In FIG. 2, barrel 2 with barrel liner 4 supports a screw (not shown) that has check valve 20 attached to it by means of threads 28. Bolts (not shown) connect barrel head 6 to barrel 2 though bolt holes 8. A nozzle (not shown) or the like is attached to the barrel head 6 by means of bolt holes 9. When check valve 20 is in the open position shown in FIG. 2, the screw is rotating and melt is fed through the check valve into a melt passageway 10 in front of the check valve 20 in a manner well understood in the metal molding art.

When the melt passageway 10 is filling the melt applies a force to inclined surface 32 to move check ring 24 forward and open a flow path between the inclined surfaces 32 and 34. Surface 40 arrests the forward movement of ring 24. During forward movement the spiral coil is only under a slight pressure from the melt and will create little resistance to the forward movement of the ring.

When melt passageway 10 is filled with melt, rotation of the screw is stopped and an injection of melt into a mold cavity (not shown) is initiated. The forward movement of the screw during injection causes a force to be applied to a forward surface of the check ring to move it back so that the inclined surfaces 32 and 34 are in contact and thereby seal the melt path.

In addition, openings 12 (shown in FIG. 3) in the side wall of ring 24 permit melt to press against the inner walls of the spiral coil and force it into sealing contact with barrel liner 4 to thereby seal against leakage along the length of the barrel during the injection cycle.

Figure 3:
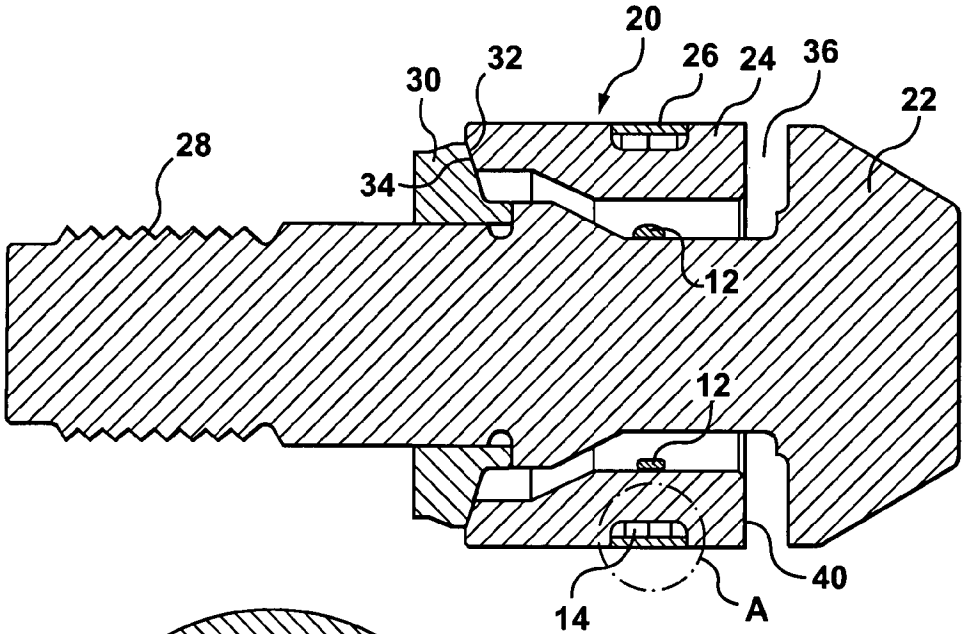
FIG. 3 is a detailed view of a portion of FIG. 2 showing the check valve with the spiral seal in the closed sealing position taken along sectional line 3-3 in FIG. 4.

As shown in FIG. 3, check valve 20 consists of main stem 22, check ring 24 and spiral coil 26. Stem 22 is attached to the end of an injection screw by means of threads 28. A shoulder 30 is fixed to the end of the injection screw.

In the closed position shown in FIG. 3, the inclined surface 32 on check valve 20 and the inclined surface 34 on shoulder 30 are pressed into sealing engagement by the back pressure exerted on ring 24 by the melt in the melt channel 36 in a manner well understood in the art.

The outside diameter of the spiral coil 26 has ample clearance to enable ease of assembly. Openings 12 permit melt to flow into the space 14 adjacent the inner circumference of the spiral coil 26. During injection, the melt in space 14 subjects the coil 26 to injection forces in an outwardly radial direction that causes the highly compliant structure of the spiral coil 26 to easily expand radially until all of the clearances are eliminated and a seal is created. Upon the dissipation of injection pressure the forces that cause the compression and expansion are no longer present and the spiral coil 26 relaxes. When the plasticizing screw (not shown) begins to turn in order to convey new material to the front of the screw any contact between the check ring 24 and the spiral coil 26 will result in an applied torque that causes the spiral coil 26 to twist such that the outside sealing diameter becomes smaller and forces a disengagement of the sealing diameter from the wall of the barrel liner thus reducing wear.

Figure 4:
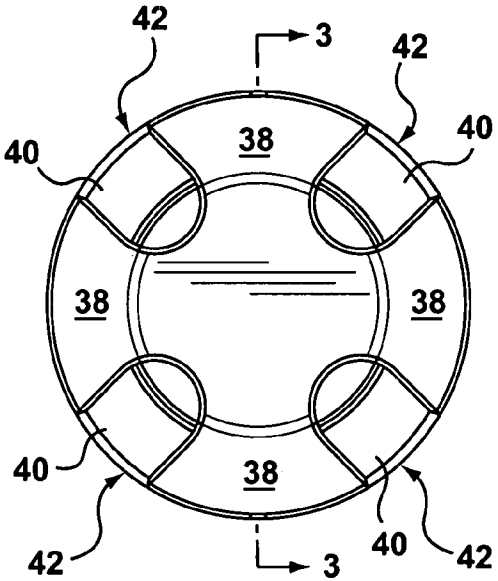
FIG. 4 is an end view of the check valve of FIG. 3.

The end of main stem 22 is furcated to form fingers 38 creating slots 42 in the melt channel 36 as shown in FIG. 4. When the injection screw is withdrawn and rotated in a manner understood in the art, the screw provides melt that moves the check ring 24 forward to open the valve 20 and permit the melt channel 36 to receive melt from the rotating screw. As the melt channel 36 fills with melt the pressure in the channel slowly moves the plasticizing screw back to its full shot position. When an injection stroke begins the closed volume of melt in front of the check ring moves the check ring 24 back to the closed position shown in FIG. 3. When the check ring 24 reaches the sealing position shown in FIG. 3, sufficient melt is provided in the melt channel 36 to enable a next injection of melt into the cavity. Rotation of the screw is stopped and the screw is translated forwardly to force melt into the mold cavity. The translational movement of the screw increases the pressure created by the melt to ensure that the melt path 36 is sealed at the inclined surfaces 32 and 34 and along the barrel surface adjacent the coil 26.

Figure 3A:
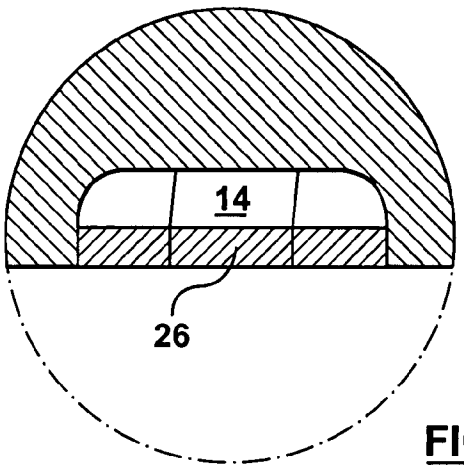
FIG. 3A is a detailed view of circled portion A of FIG. 3 showing the relationship between the spiral geometry and the groove more closely.

As more clearly shown in FIG. 3A, the coil 26 is substantially rectangular in cross section. The outer circumferential surfaces of the coil are machined to a high tolerance so that they will tightly interface with the wall of an associated barrel liner. The inner circumferential surfaces could be other shapes such as convex or concave. The only limitation on the shape of the inner circumferential surfaces is that they have sufficient surface to ensure the transmission of adequate force to move the coils into sealing engagement with the barrel liner surface. The radial surfaces of each turn of the coil are also machined to a high tolerance to ensure that adjacent turns of the coil seal effectively against one another. The outer radial surfaces of the outer coils and the surfaces they contact on the check ring should also be machined to a high tolerance to ensure good sealing.

Figure 5B:
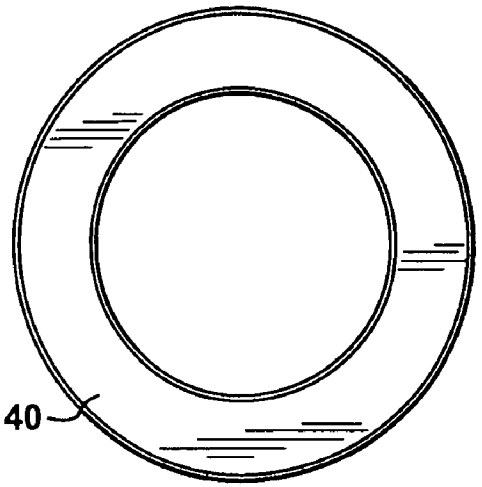
FIGS. 5A and 5B are sectional and end views, respectively, of the check ring shown in FIG. 5.
Figure 5A:
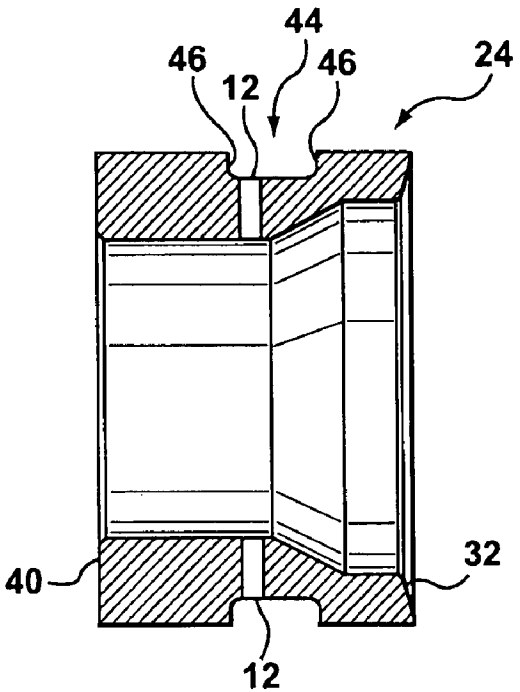
Figure 5:
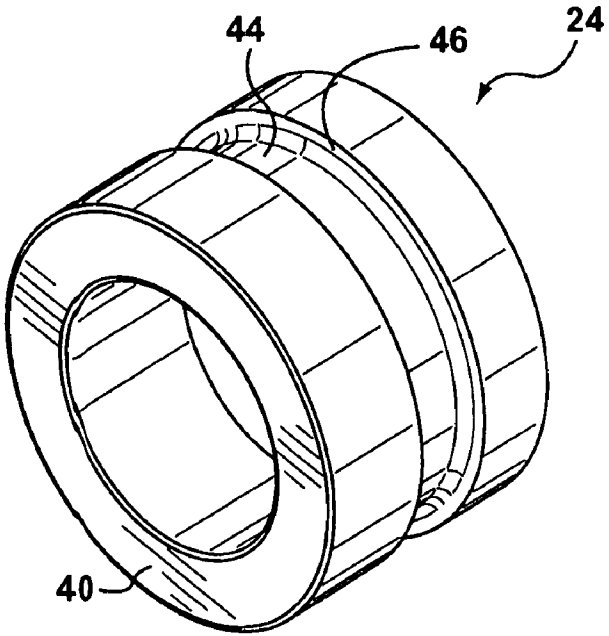
FIG. 5 is a perspective view of the check ring of the invention.

Check ring 24 is shown more explicitly in FIGS. 5, 5A and 5B. Ring 24 has a circular slot 44 on its periphery. The slot 44 is shown located near the middle of the ring 24 but could be located nearer either end if desired. The only limitation is that the wall sections 46 and 48 adjacent the slot should have sufficient strength to withstand pressures exerted by the coil 26 when mounted in the slot 44.

Figure 6B:
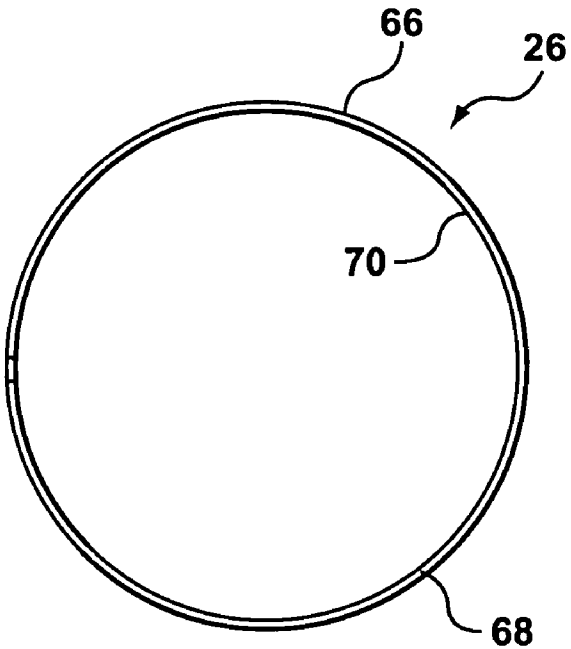
FIGS. 6A and 6B are sectional and end views, respectively, of the spiral coil shown in FIG. 6.
Figure 6A:
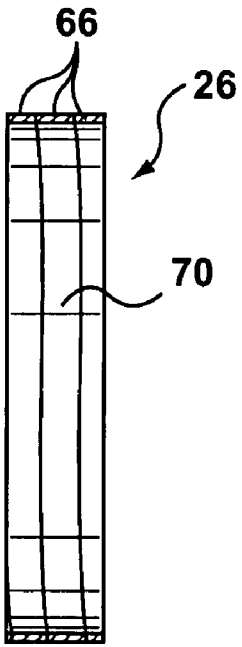
Figure 6:
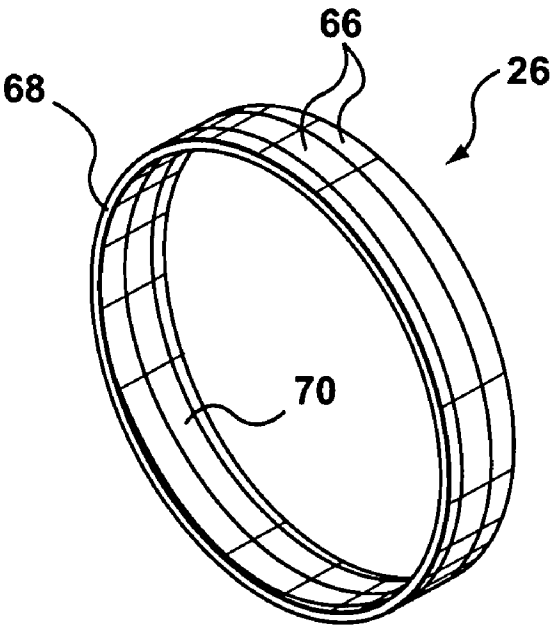
FIG. 6 is a perspective view of the spiral coil to be fitted on the check ring of FIG. 5 to seal the check ring.

Spiral coil 26 is shown more explicitly in FIGS. 6, 6A and 6B. As shown in these FIGs., outer circumferential surfaces 66 are machined to a high tolerance. Radial surfaces 68 are also machined to a high tolerance. Inner circumferential surfaces 70 need not be made to a high tolerance as they contact the melt during operation.

Figure 7:
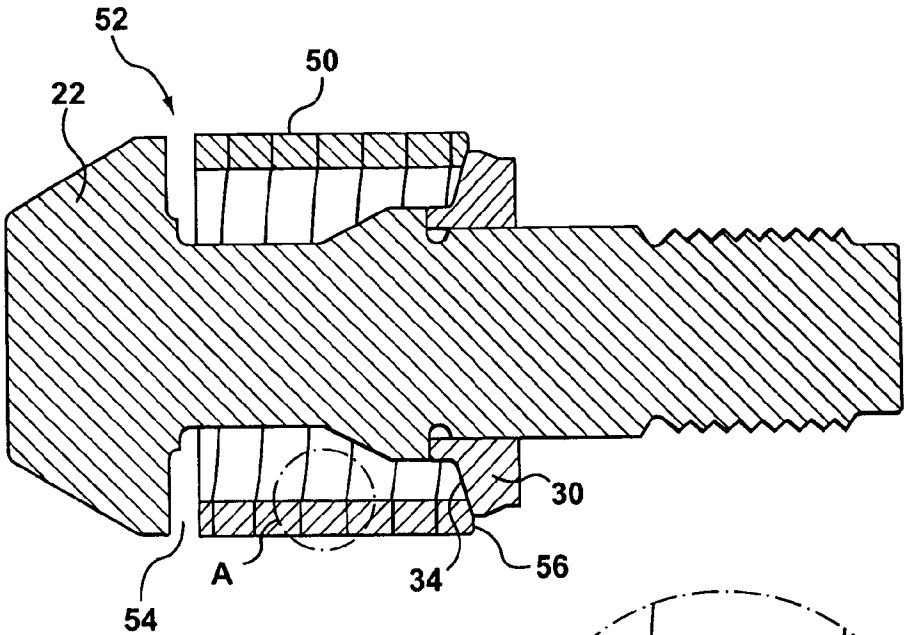
FIG. 7 is a cross sectional view along sectional line 7-7 of FIG. 8 of a check valve with a spiral coil functioning as a seal and check ring.

FIG. 7 shows a check ring coil 50 that combines the actions of opening and closing the check valve 52 and sealing the melt channel 54. In this embodiment, the surface 56 of the outer coil of coil 50 engages the inclined surface 34 to close the valve as shown. The circumferential surfaces of the turns of the coil 50 engage the walls of the barrel to seal the walls against any back flow of the melt. The flexibility in the turns of the coil 50 ensure that even with wear in the barrel the coil 50 will continue to provide a reliable seal as the pressure of the melt against the inner walls of the coil 50 will force the outer walls of the coil against the barrel. Accordingly, the seal along the wall will only start to erode when the barrel is so worn that the expansion of the coils is insufficient to cover the wear gap.

For metal molding, the spiral coil must be made of material that is stable at high operating temperatures, such as 600 Degrees C. for magnesium molding, and inert to corrosion. For example, when molding magnesium, nickel should not be present.

The stem 22 shown in FIG. 7 is essentially the same as stem 22 shown in FIG. 3 so like reference numerals have been used to identify the same parts of the stem. Stem 22 need not be further described here.

Figure 7A:
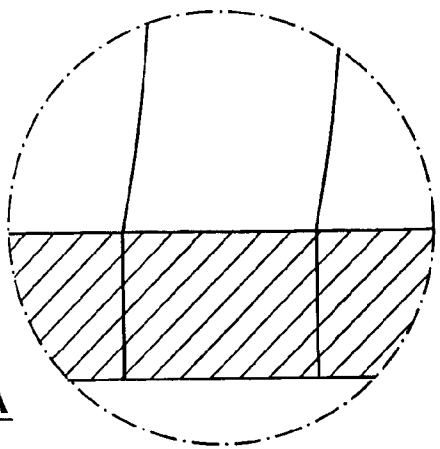
FIG. 7A is an enlarged view of the area A from FIG. 7.

FIG. 7A shows more clearly the machined surfaces of the coil 50.

Figure 8:
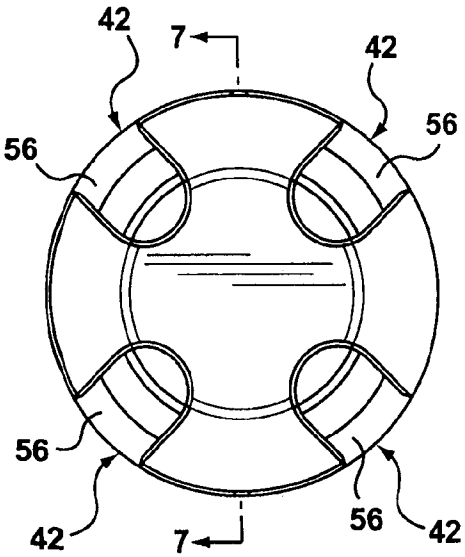
FIG. 8 is an end view of the check valve shown in FIG. 7.

FIG. 8 is an end view of the check valve 52 shown in FIG. 7 and includes slots 42 for permitting the flow of melt into an injection cavity.

Figure 9:
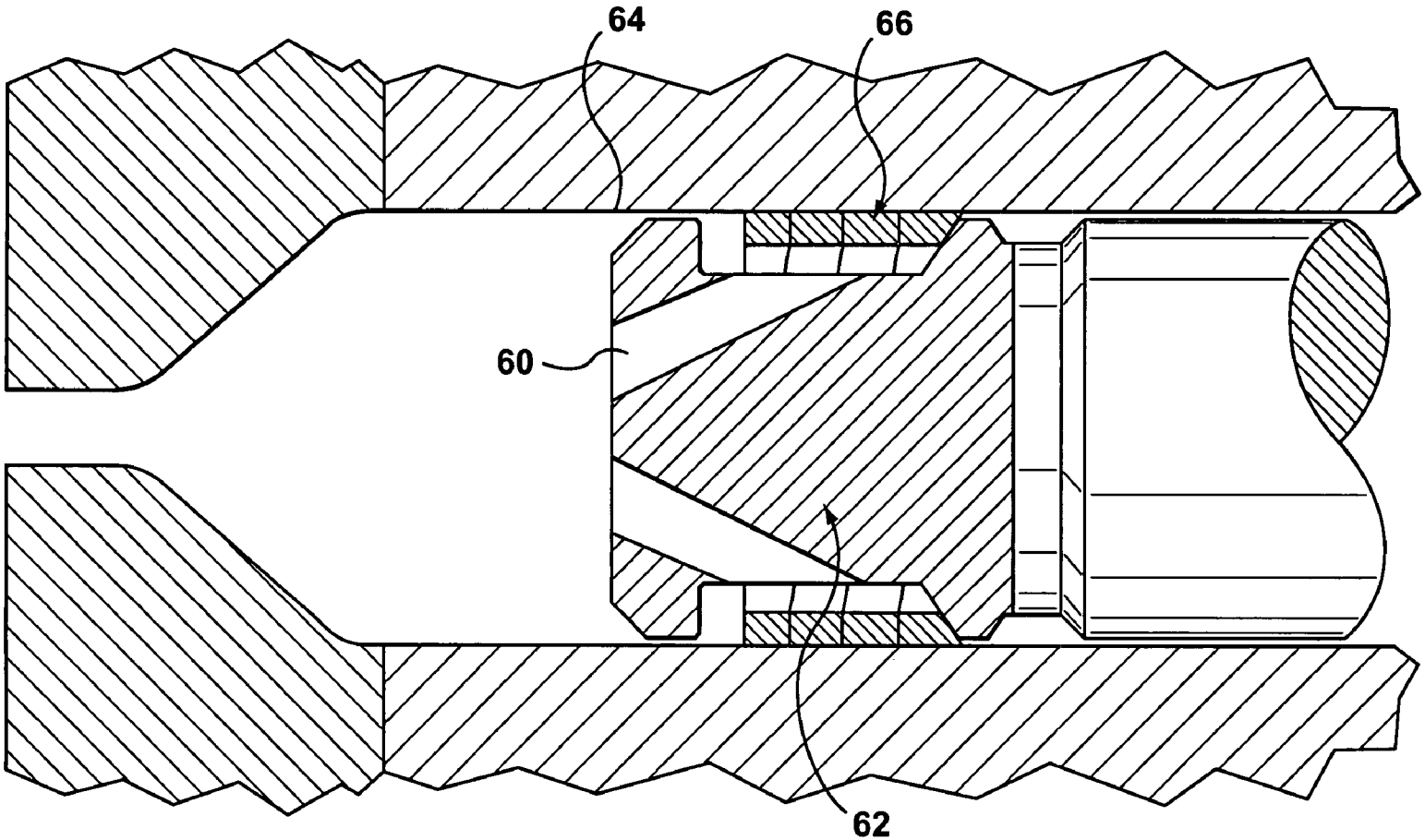
FIG. 9 is a further embodiment of the invention where the spiral coil combines as a check ring and seal.

FIG. 9 illustrates a further embodiment of the invention. In this embodiment, a melt flow channel 60 extends from the periphery of the check valve toward the interior of a barrel shown schematically at 64. Spiral coil 66 acts as a check ring and seal for the check valve in a manner similar to that described hereinbefore with reference to FIGS. 7 and 8.

Figure 10:
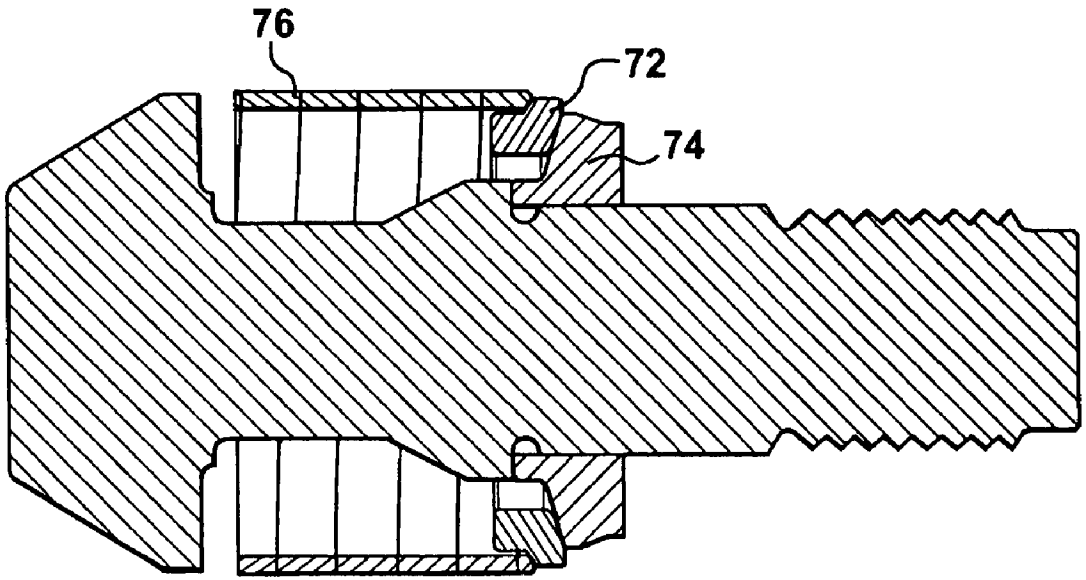
FIG. 10 is a cross-sectional view of a further embodiment of the invention that includes a wear ring between the spiral coil check valve and seal and is taken along sectional line 10-10 in FIG. 11.
Figure 11:
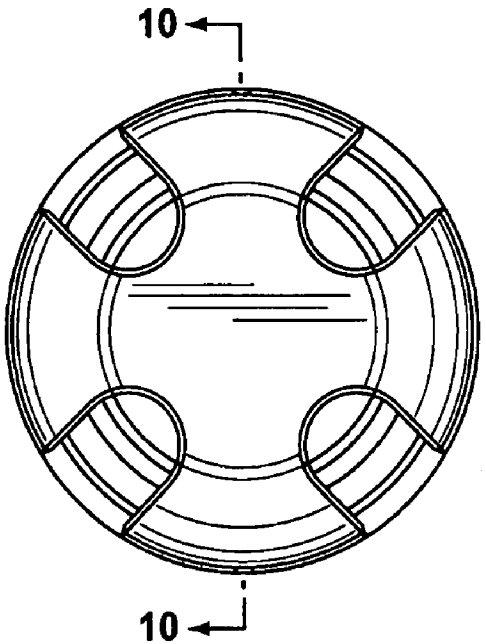
FIG. 11 is an end view of the check valve shown in FIG. 10.

FIGS. 10 and 11 show a further embodiment of the invention. In this embodiment, a ring 72 is situated between a seat 74 on a screw (not shown) and a spiral coil 76. Ring 72 permits the use of a thinner coil 76 while maintaining the required flow path. The ring 72 moves back and forth with the coil 76

It will, of course, be understood that the above description has been given by way of example only and that modifications in detail may be made within the scope of the present invention.

What is claimed is:

1. A check valve for a metal molding machine, said valve including a peripheral groove in an outer surface of said check valve and a helically wound coil in said groove, said coil being expandable into sealing engagement with a cylindrical wall of said molding machine.

2. A check valve as defined in claim 1 wherein said helically wound coil is movable laterally between a melt channel open position and a melt channel closed position.

3. A check valve as defined in claim 1 wherein turns of said coil are substantially rectangular in cross-section.

4. A check valve as defined in claim 2 wherein adjacent surfaces of turns of said coil are machined to a high tolerance to ensure sealing between adjacent turns when said coil is compressed.

5. A check valve as defined in claim 2 wherein outer surfaces of turns of said coil are machined to a high tolerance so as to tightly seal against said wall when said coil is expanded.

6. A check valve for a metal molding machine, said valve including a helically wound coil, said coil sealing said check valve and slidable on a cylinder of said check valve to open and close a flow path through said valve, a first turn of said coil having a surface conforming to a mating surface on said cylinder to close said valve when in contact with said mating surface, outer peripheral surfaces of said coil conforming to a cylinder wall surrounding said check valve to provide an axial seal for said check valve.

7. A check valve as defined in claim 6 wherein each turn of said coil other than a first turn have flat radial walls that provide a radial seal when pressed together.

8. In a check valve for a metal molding machine, a helical coil, said coil sealing said check valve and axially translatable to open and close a flow path through said valve, a first turn of said coil having a surface conforming to a mating surface on said check valve body to close said valve when in contact with said mating surface and outside radial surfaces of said coil conforming to a cylinder wall surrounding said check valve to provide a radial seal for said check valve.

9. A coil as defined in claim 8 wherein each turn of said coil other than said first turn has a flat axial wall that provides an axial seal between each turn when subjected to an axial force.

* * * * *